US011333468B2

(12) United States Patent
Willson

(10) Patent No.: US 11,333,468 B2
(45) Date of Patent: May 17, 2022

(54) SHOT SHELL WITH PROJECTILE

(71) Applicant: Wattre, Inc., Woodburn, IN (US)

(72) Inventor: Jonathan S. Willson, Cecil, OH (US)

(73) Assignee: Wattre, Inc., Woodburn, IN (US)

( * ) Notice: Subject to any disclaimer, the term of this patent is extended or adjusted under 35 U.S.C. 154(b) by 0 days.

(21) Appl. No.: 16/930,926

(22) Filed: Jul. 16, 2020

(65) Prior Publication Data

US 2021/0102789 A1 Apr. 8, 2021

Related U.S. Application Data

(60) Provisional application No. 62/874,591, filed on Jul. 16, 2019.

(51) Int. Cl.

| | |
|---|---|
| ***F42B 5/067*** | (2006.01) |
| ***F42C 19/08*** | (2006.01) |
| ***F42B 7/02*** | (2006.01) |
| ***F42B 5/16*** | (2006.01) |

(52) U.S. Cl.

CPC ..... *F42B 5/067* (2013.01); *F42B 5/16* (2013.01); *F42B 7/02* (2013.01); *F42C 19/083* (2013.01)

(58) Field of Classification Search

CPC .. F42C 19/083; F42B 7/02; F42B 7/06; F42B 7/08; F42B 7/12; F42B 5/16; F42B 5/067; F42B 5/073; F42B 5/145; F42B 5/15; F42B 8/00; F42B 12/36; F42B 12/40

USPC ..... 102/430, 439, 442, 502, 513, 512

See application file for complete search history.

(56) References Cited

U.S. PATENT DOCUMENTS

| | | | | |
|---|---|---|---|---|
| 7,793,591 | B1 * | 9/2010 | Van Stratum | F42C 9/10 102/443 |
| 7,987,790 | B1 * | 8/2011 | Scarr | F42B 5/025 102/503 |
| 8,661,983 | B1 * | 3/2014 | Scarr | F42B 10/38 102/503 |
| 8,887,641 | B1 * | 11/2014 | Manole | F42B 14/06 102/521 |
| 9,010,248 | B1 * | 4/2015 | Manole | F42B 5/02 102/439 |
| 9,021,961 | B1 * | 5/2015 | Manole | F42B 10/14 102/524 |
| 9,068,807 | B1 * | 6/2015 | Thomas | F42B 15/10 |
| 9,140,528 | B1 * | 9/2015 | Thomas | F42B 12/36 |
| 9,200,876 | B1 * | 12/2015 | Thomas | F42C 19/0823 |
| 2011/0067593 | A1 * | 3/2011 | Klein | F42B 12/745 102/439 |
| 2012/0067242 | A1 * | 3/2012 | Shin | F42B 12/40 102/364 |

(Continued)

*Primary Examiner* — John Cooper
(74) *Attorney, Agent, or Firm* — Taylor IP, P.C.

(57) ABSTRACT

A cartridge assembly that includes a non-lethal projectile and a carrier configured for retaining and launching the non-lethal projectile. The carrier includes a housing including a combustion chamber, at least one escape aperture, a primer, and a case connected to the housing. The case encases the non-lethal projectile. The case and the housing collectively define a launch chamber that is fluidly connected to the at least one escape aperture. The launch chamber is configured for launching the non-lethal projectile out of the case. The at least one escape aperture is configured for metering pressurized gas from the combustion chamber to the launch chamber for launching the non-lethal projectile.

20 Claims, 9 Drawing Sheets

(56) References Cited

U.S. PATENT DOCUMENTS

2018/0156587 A1* 6/2018 Raquin ..... F42B 12/40
2018/0238665 A1* 8/2018 Dumont ..... F42C 19/083

* cited by examiner

SHOT SHELL WITH PROJECTILE

CROSS REFERENCE TO RELATED APPLICATIONS

This is a non-provisional application based upon U.S. provisional patent application Ser. No. 62/874,591, entitled "SHOT SHELL WITH PROJECTILE", filed Jul. 16, 2019, which is incorporated herein by reference.

BACKGROUND OF THE INVENTION

1. Field of the Invention

The present invention relates generally to cartridges, and more particularly, to a cartridge assembly with a carrier that retains and launches a frangible non-lethal projectile.

2. Description of the Related Art

Non-lethal cartridges allow a user to directly contact a target with a projectile without causing serious or lethal injury. Non-lethal cartridges may be used in a wide variety of applications. For instance, military personnel and police officers may use non-lethal cartridges to conduct crowd control or secure a particular site. Additionally, conservation officers may use non-lethal cartridges to mark wildlife.

A typical non-lethal cartridge includes a non-lethal projectile, a case for holding the non-lethal projectile, and a primer for igniting gunpowder that launches the non-lethal projectile out of the case. A non-lethal projectile may include a rubber bullet, a bean bag, a gas canister, or a paintball. A hallmark of a non-lethal cartridge is a low projectile velocity which does not cause lethal injury upon impact. Another common trait of a non-lethal cartridge is a high caliber, which requires a riot shotgun or launcher for firing the projectile. In operation, the firing pin of the weapon strikes the primer which ignites the gunpowder. The ignited gunpowder generates a pressurized gas that instantaneously releases its pressure into the case. Thereafter, the pressurized gas forces the projectile out of casing and through the barrel of the weapon.

Some non-lethal projectiles may be configured to carry a payload, such as a liquid or gas. For instance, a non-lethal projectile may include a sealed compartment for carrying a florescent paint for marking a target. As can be appreciated, the non-lethal projectile must be frangible so that it breaks apart upon impact in order to disperse its payload. A common problem with such a frangible non-lethal projectile is premature rupturing or fracturing of the frangible body of the non-lethal projectile upon launching the non-lethal projectile out of the case. The highly pressurized gas, expelled by the ignited gunpowder, may impart too great a force onto the non-lethal projectile which causes premature breaking of the non-lethal projectile.

What is needed in the art is a cost-effective non-lethal cartridge which reduces the risk of prematurely breaking a frangible non-lethal projectile.

SUMMARY OF THE INVENTION

The present invention provides a cartridge assembly that has a carrier for temporarily retaining and launching a frangible non-lethal projectile. The carrier includes a housing including a combustion chamber, at least one escape aperture, a primer, and a case connected to the housing. The case encases the non-lethal projectile. The case and the housing collectively define a launch chamber that is fluidly connected to the at least one escape aperture. The launch chamber is configured for launching the non-lethal projectile out of the case. The at least one escape aperture is configured for metering pressurized gas from the combustion chamber to the launch chamber for launching the non-lethal projectile.

The invention in one form is directed to a cartridge assembly that includes a non-lethal projectile and a carrier configured for retaining and launching the non-lethal projectile. The carrier includes a housing including a combustion chamber and at least one escape aperture fluidly connected to the combustion chamber. The combustion chamber is configured for housing an ignitable powder. The carrier also includes a primer connected to the housing and at least partially disposed within the combustion chamber. The primer is configured for igniting the ignitable powder within the combustion chamber. The carrier also includes a case connected to the housing. The case encases the non-lethal projectile. The case and the housing collectively define a launch chamber that is fluidly connected to the at least one escape aperture. The launch chamber is configured for launching the non-lethal projectile out of the case. The at least one escape aperture is configured for metering pressurized gas from the combustion chamber to the launch chamber for launching the non-lethal projectile.

The invention in another form is directed to a carrier for a non-lethal projectile. The carrier includes a housing with a combustion chamber and at least one escape aperture fluidly connected to the combustion chamber. The combustion chamber is configured for housing an ignitable powder. The carrier also includes a primer connected to the housing and at least partially disposed within the combustion chamber. The primer is configured for igniting the ignitable powder within the combustion chamber. The carrier also includes a case connected to the housing. The case is configured for encasing the non-lethal projectile. The case and the housing collectively define a launch chamber that is fluidly connected to the at least one escape aperture. The launch chamber is configured for launching the non-lethal projectile out of the case. The at least one escape aperture is configured for metering pressurized gas from the combustion chamber to the launch chamber for launching the non-lethal projectile.

An advantage of the present invention is that the carrier provides two separate chambers for respectively igniting the gunpowder and launching the projectile, which protects the frangible non-lethal projectile from the higher pressures within the combustion chamber.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
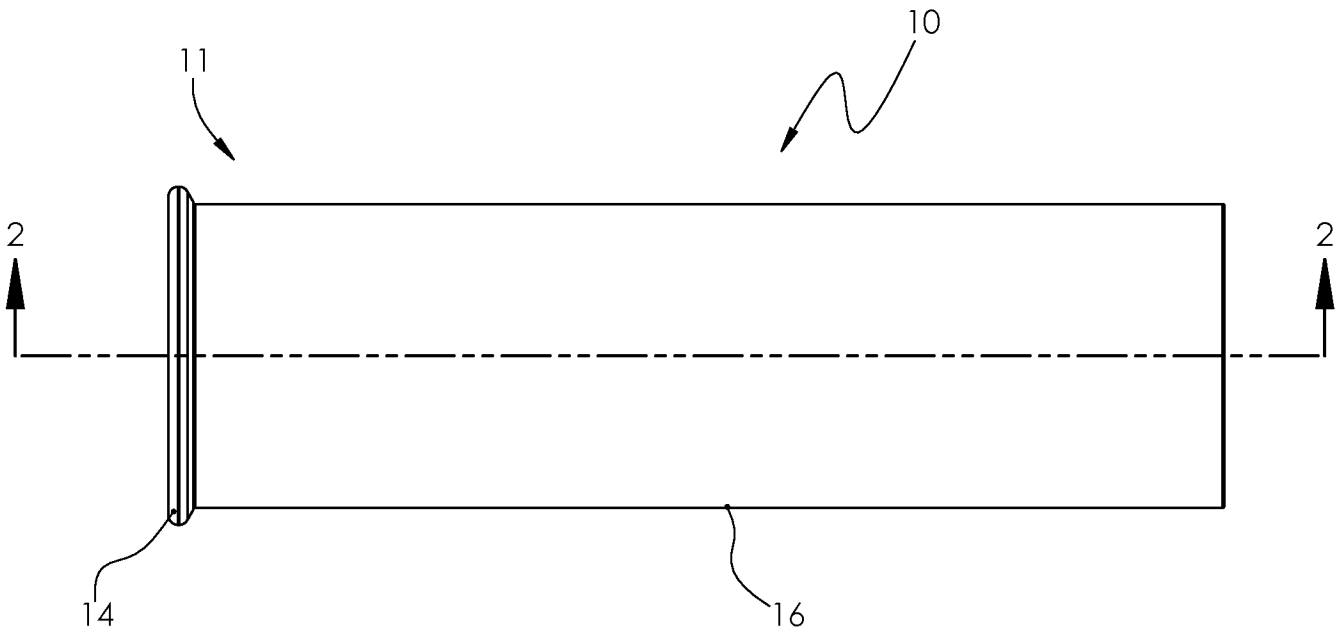
FIG. 1 is a top view of a cartridge assembly including a carrier and a frangible projectile.
Figure 2:
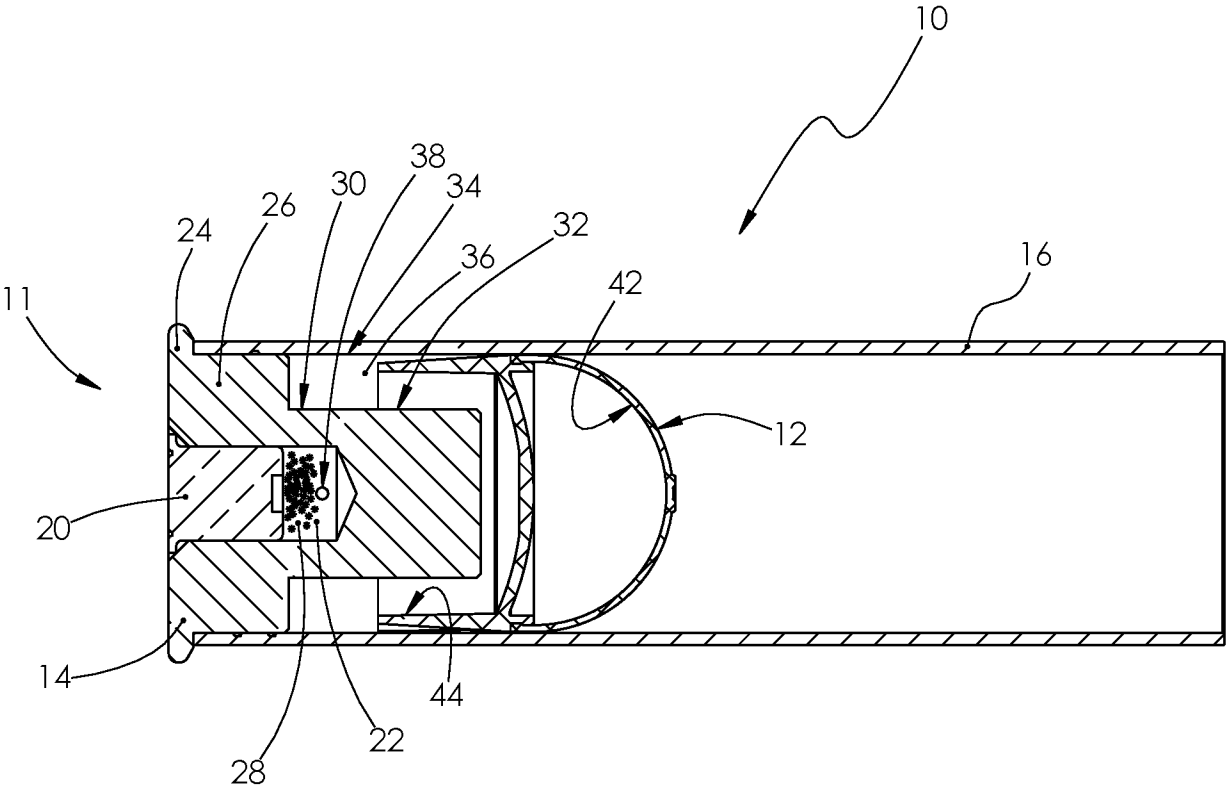
FIG. 2 is a cross-sectional view of the cartridge assembly, taken across line 2-2 in FIG. 1.
Figure 3:
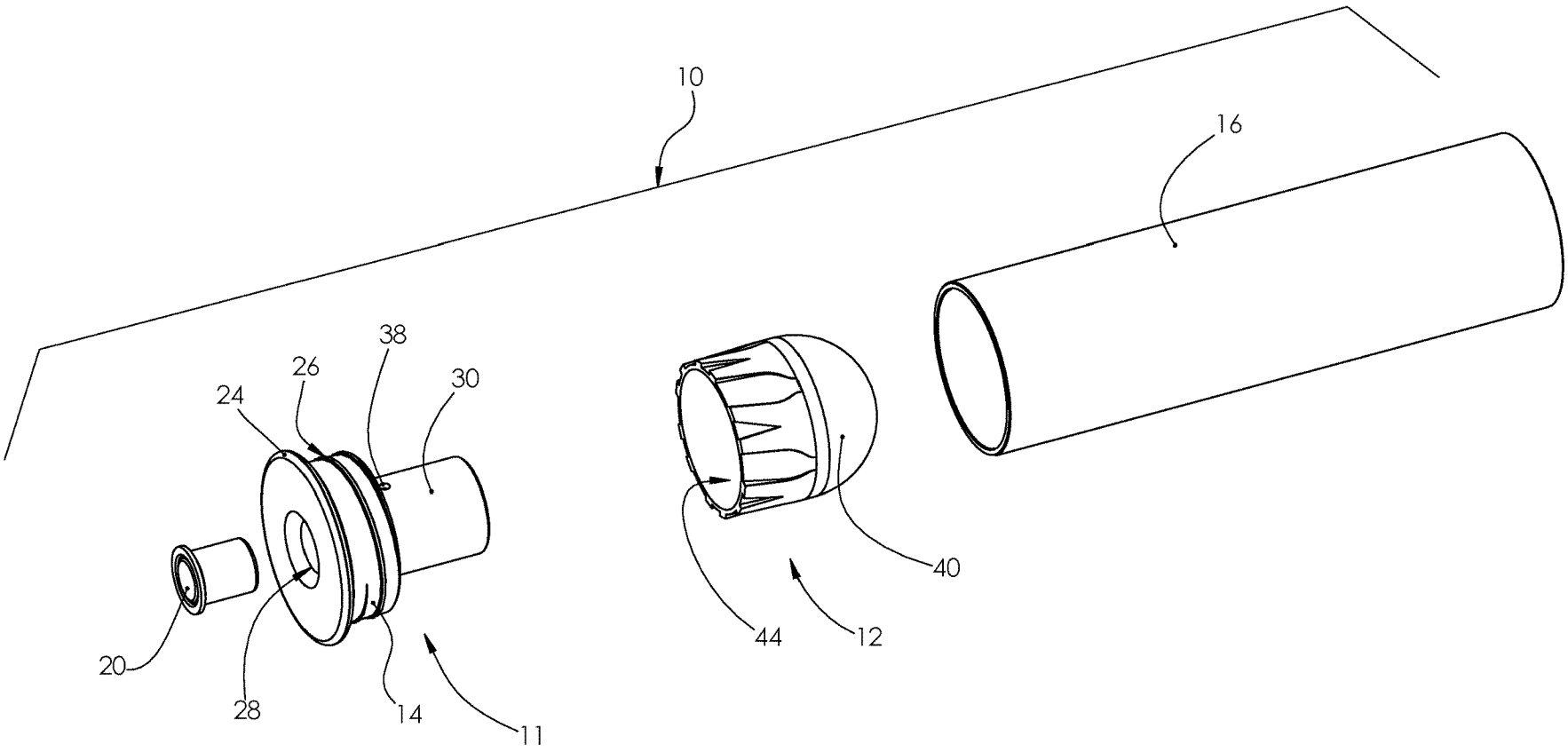
FIG. 3 is an exploded perspective view of the cartridge assembly of FIGS. 1-2.

Referring now to the drawings, and more particularly to FIGS. 1-3, there is shown a cartridge assembly 10. The cartridge assembly 10 generally includes a carrier 11 and an aerodynamic, non-lethal projectile 12 that is held or carried within the carrier 11. The cartridge assembly 10 is a non-reloaded cartridge assembly.

The carrier 11 temporarily retains and launches the projectile 12. The carrier 11 may include a housing 14, a case 16, a primer 20, and an ignitable powder 22 that is housed within the housing 14. The carrier 11 may be sized and shaped similar to a shotgun shell and is used in connection with a firearm, such as a shotgun. In some embodiments, the carrier 11 may be in the form of a shotgun shell 11.

The housing 14 has a flange 24, a shoulder 26, and a cavity 28, i.e., a combustion chamber 28 for housing the gunpowder 22. The flange 24 may be knurled to provide a grip surface for retaining the case 16 in a pressure fit manner. Alternately, the flange 24 may have barbs (not shown) or other members to grasp the case 16 to keep the case 16 retained to the housing 14. The housing 14 is generally made of a metal, such as a steel or aluminum.

One end of the housing 14 is open and the other opposite end of the housing 14 is closed. The open end of the housing, i.e., open end of the cavity 28, is closed by the primer 20. Therein, the interior of the cavity 28 forms a powder chamber 28 for housing the powder 22. After firing, the powder chamber 28 also operates as a combustion chamber 28. The pressure within the powder chamber 28 may be approximately 4,000 pounds per square inch (psi), plus or minus 500 psi.

The housing 14 also has a stepped down portion 30 that provides a relief 36 between an exterior surface 32 of the housing 14 and the interior surface 34 of the case 16. In other words, the housing 14 also has a first section with a first outer diameter and a second section with a second outer diameter that is smaller than the first outer diameter. The relief 36 forms a breach chamber 36 or launch chamber 36 for launching the projectile 12. As can be seen, for example in FIG. 2, stepped down portion 30 extends over half way into rear cavity 44 of projectile 12.

The housing 14 also has at least one escape aperture 38. The at least one escape aperture 28 fluidly connects combustion chamber 28 and the launch chamber 36. As shown in FIG. 2, the embodiment illustrated has two escape apertures 38. The escape apertures 38 provide for metering of pressurized gas from the combustion chamber 28 to the launch chamber 36 for launching the projectile 12. Therein, the escape apertures 38 allow the launch chamber 36 to have a lower internal pressure than the internal pressure within the combustion chamber 28. Hence, the escape apertures 38 allow the powder 22 to be ignited at a relatively high pressure in an isolated combustion chamber 28, and then allow the projectile 12 to be launched via a relatively low pressure from a subsequent launch chamber 36. In one embodiment, the escape apertures 38 have a diameter of approximately 0.026 inches. However, if less than two escape apertures 38 are provided, then the diameter of the single escape aperture 38 may have to be greater than 0.026 inches. Additionally, if more than two escape apertures 38 are provided, then the diameter of each aperture 38 may need to be less.

It should be appreciated that the pressure of the gas within the launch chamber 36 can be adjusted by decreasing the amount of powder 22 and/or decreasing the size or number of the escape apertures 38. Typically, the maximum pressure in the launch chamber 36, following the ignition of the powder 22 in the powder chamber 28 that vents out the escape apertures 38, is approximately 200 psi, plus or minus 100 psi.

The case 16 houses the projectile 12. The case 16 is secured to the shoulder 26 of the housing 14 against the flange 24. Thereby, the case 16 at least partially surrounds the housing 14. The case 16 is generally cylindrical in shape. The case 16 may be made of any desired material, such as metal and/or plastic. The interior surface 34 of the case 16 forms an exterior wall for the launch chamber 36.

The primer 20 is a standard ammunition primer and may be made up of an anvil, primer cap, and priming compound (not shown). When the primer 20 is struck by the firing pin of the gun it ignites the powder 22 contained inside the powder chamber 28.

The powder 22 is generally any chemical compound that is used to create a high-pressure gas when ignited by a primer 20. For example, the powder 22 may be gunpowder 22.

The projectile 12 may be a non-lethal projectile for non-lethal uses, including recreational play. The aerodynamic projectile 12 may generally include a shell 40 having a first front closed cavity 42 and a second open rear cavity 44 (FIGS. 2-3). The front closed cavity 42 may be filled with a payload. The payload may be in the form of a fluorescent paint or an immobilizing component, such as an irritant or other noxious chemical. The irritant or noxious chemical can be in a liquid, powder, or a gaseous state. The shell 40 of the aerodynamic projectile 12 may fracture upon impact and may be used to mark a target. The projectile 12 may have a maximum diameter of about 0.690 inches, which is the diameter of a typical paint ball. The velocity of the projectile 12, as the projectile 12 escapes from the gun barrel, may be approximately 300-500 ft/sec. It is important to provide sufficient pressure to fire the projectile 12. However, because the projectile 12 is frangible, care must be had not to rupture or fracture the projectile 12 within the carrier 11 or the gun barrel due to providing too much gas pressure.

In use, the projectile 12 is placed within the case 16 and against the shell housing 14. A sufficient amount of powder 22 is provided within the powder chamber 28. Then, the powder chamber 28 is closed off at one end by the primer 20. When the gun trigger is pulled, the firing pin strikes the primer 20, which causes the primer 20 to ignite the powder 22 in the powder chamber 28. The powder 22 in the powder chamber 28 burns and creates a gas under high pressure. The high-pressure gas vents out of the powder chamber 28 through the escape apertures 38 and into the launch chamber 36 adjacent the projectile 12. The gas pressure forces the projectile 12 out of the case 16 and down the barrel of the gun and is fired out of the gun.

In a typical use scenario, the carrier 11 is a single use component. This means that after the projectile 12 is shot out of the carrier 11 the carrier 11 is removed from the gun and a new carrier 11 is inserted into the gun for firing another projectile 12. Alternately, however, in certain instances the used carrier 11 may be reloaded with a new primer 20, additional powder 22, and a new projectile 12.

Figure 4:
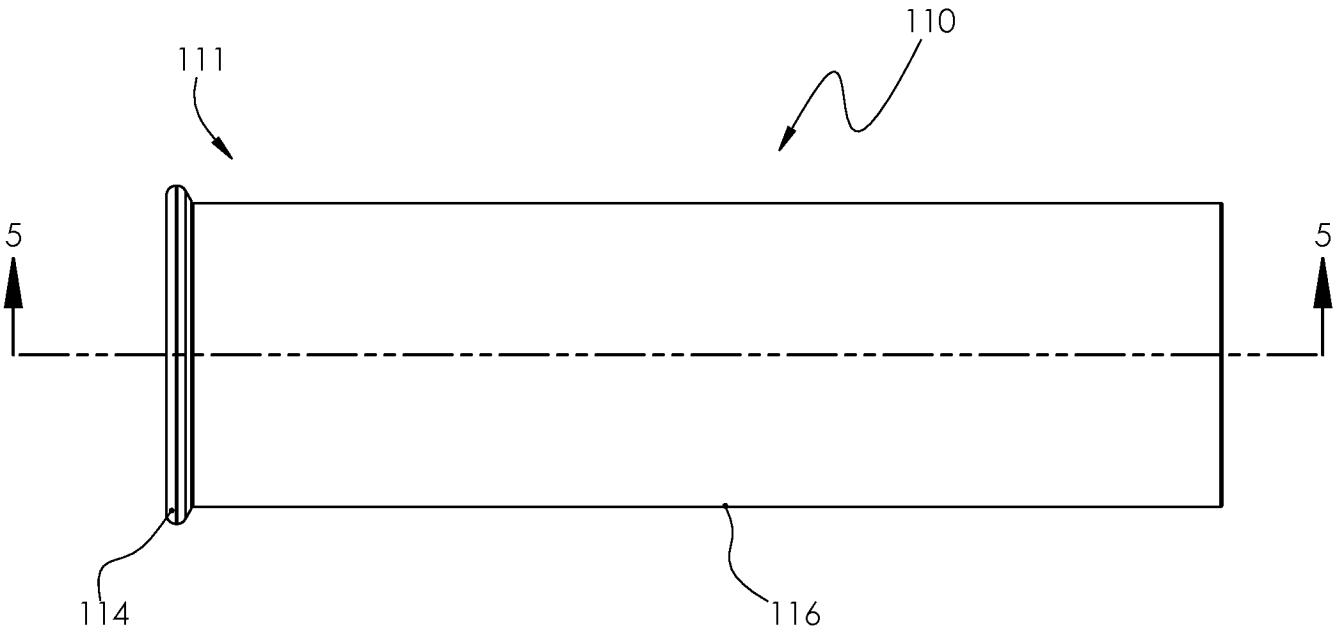
FIG. 4 is a top view of another embodiment of a cartridge assembly including a carrier and a frangible projectile.
Figure 5:
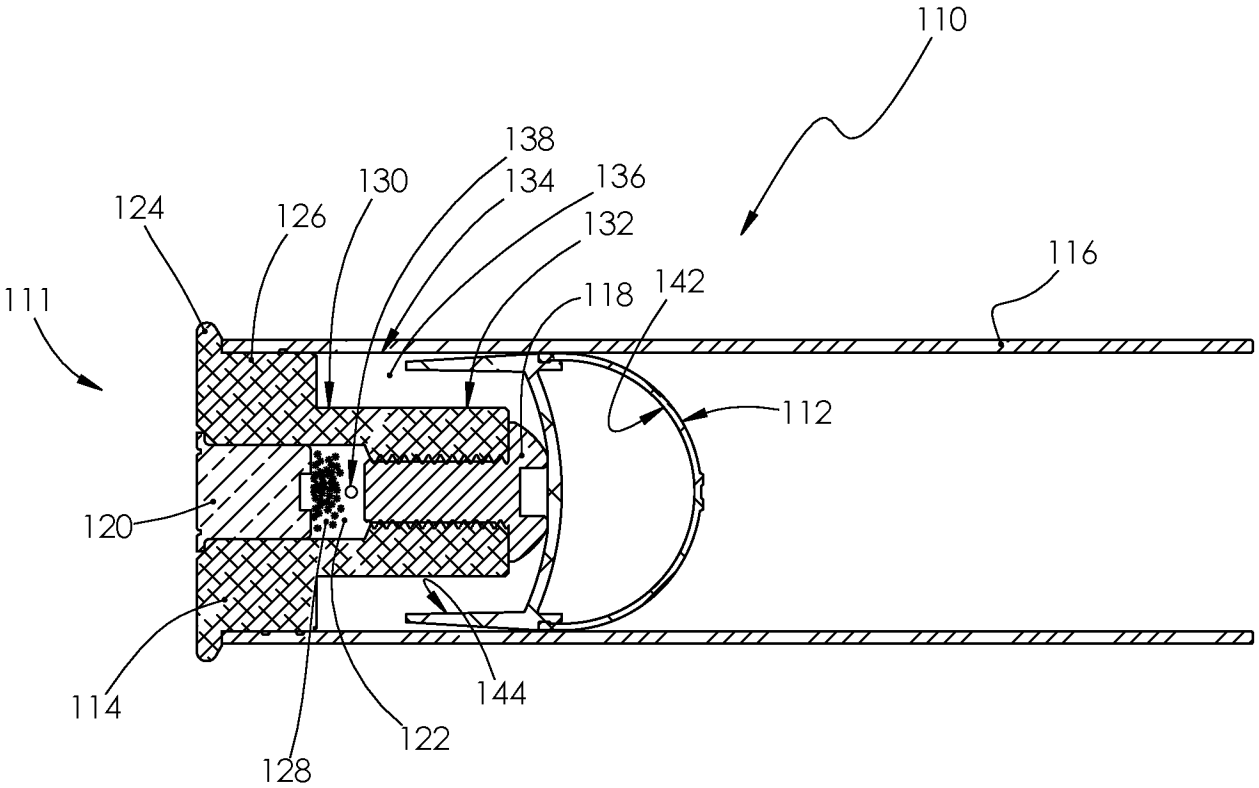
FIG. 5 is a cross-sectional view of the cartridge assembly, taken across line 5-5 in FIG. 4.
Figure 6:
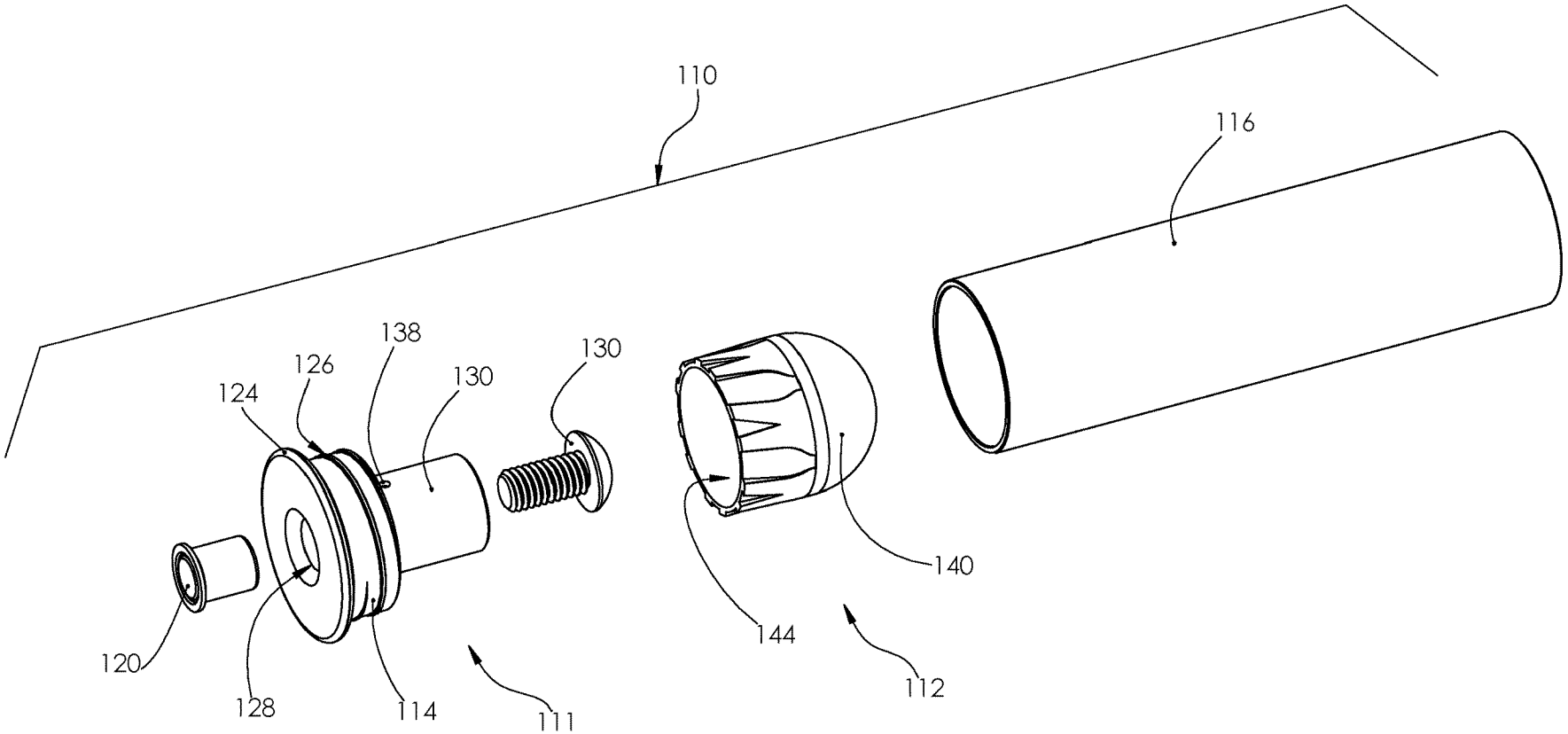
FIG. 6 is an exploded perspective view of the cartridge assembly of FIGS. 4-5.

Referring now to FIGS. 4-6, there is shown another embodiment of a cartridge assembly 110. The cartridge assembly 110 may be substantially similar to the cartridge assembly 10, as discussed above, except that the cartridge assembly 110 includes a removable plug 118 for reloading the housing 114 with powder 122. Thereby, the cartridge assembly 110 is configured as a reloadable cartridge assembly. Like components have been identified with like reference characters, except for the 100 series designation.

The housing 114 of the cartridge assembly 110 has a cavity or combustion chamber 128 that axially extends through the entire body of the housing 114. Therein, both ends of the housing 114 are open. One end of the housing 114 is closed off by the primer 120 and the opposite end is closed off by the plug 118. The end of the housing 114 which receives the plug 118 may be threaded.

The plug 118 is removably connected to the housing 114. The plug 118 allows a user to selectively close the combustion chamber 128. After the cartridge assembly 110 has been fired, the plug 118 also allows a user to refill the housing 114, i.e., combustion chamber 128, with subsequent powder 122. The end of the plug 118 directly contacts the projectile 112 (FIG. 5). The plug 118 may be a threaded component, such as a screw 118.

Figure 7:
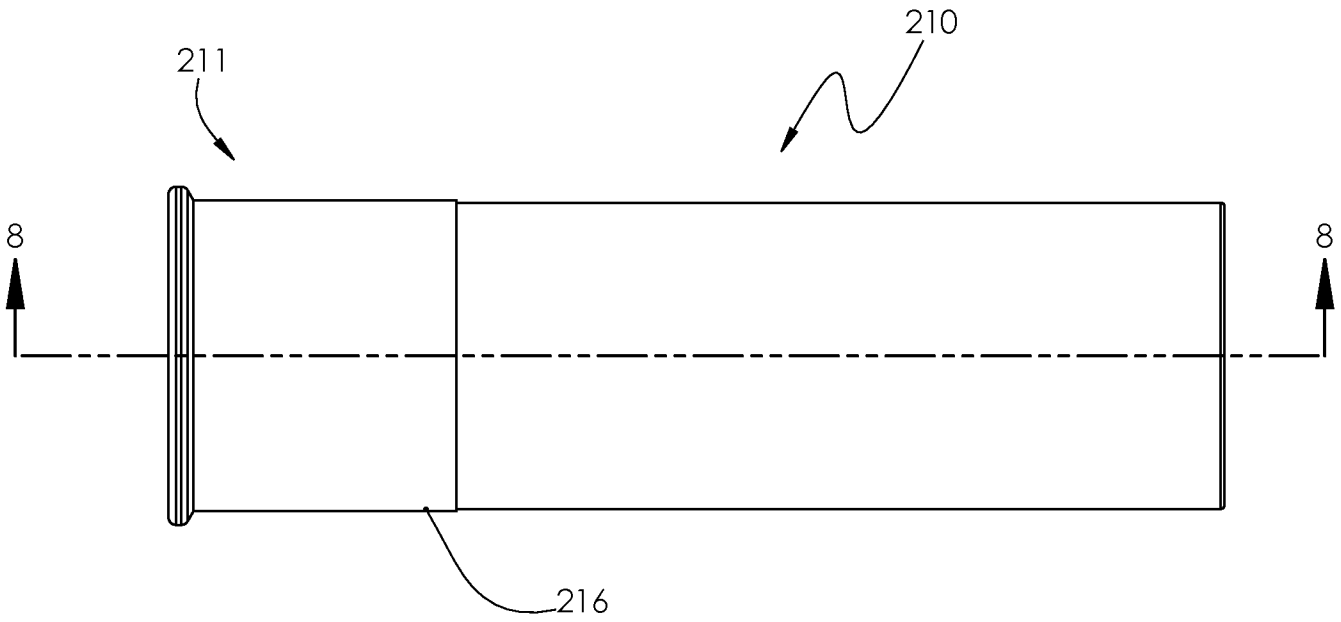
FIG. 7 is a top view of another embodiment of a cartridge assembly including a carrier and a frangible projectile.
Figure 8:
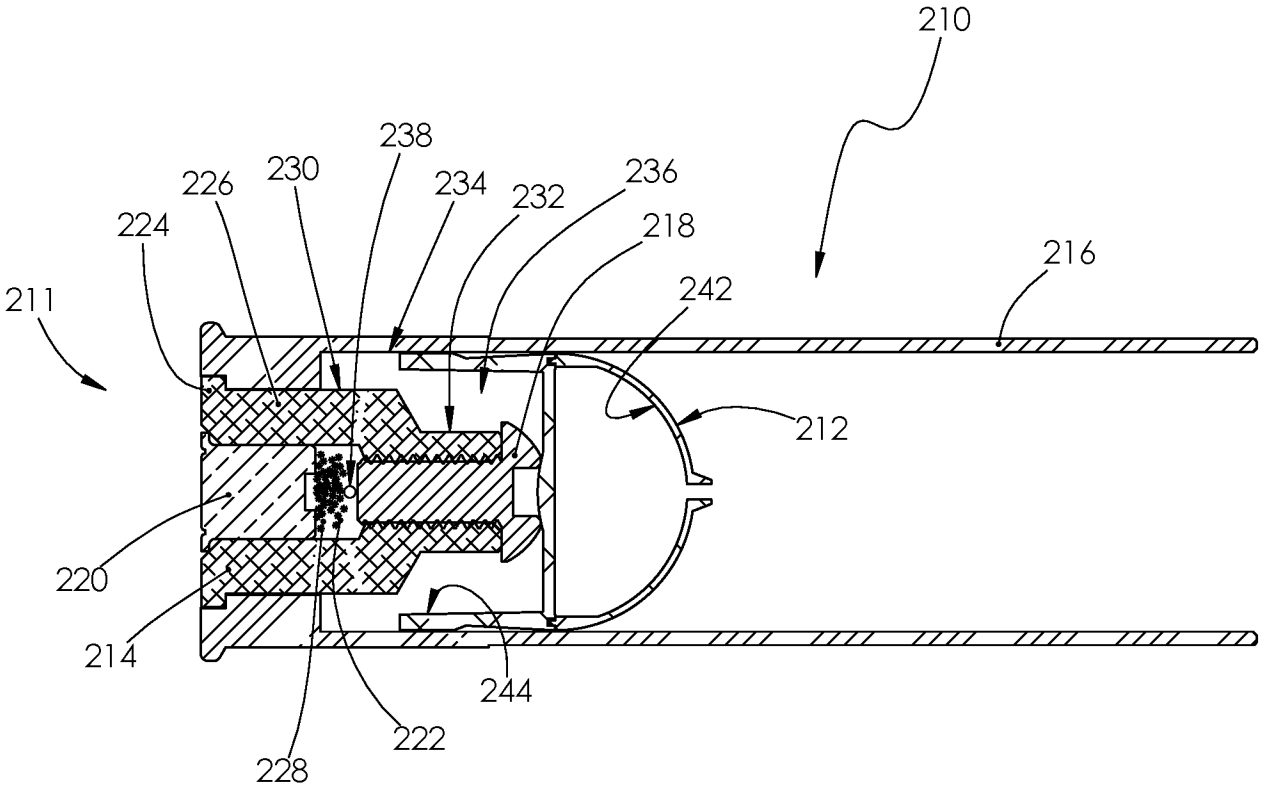
FIG. 8 is a cross-sectional view of the cartridge assembly, taken across line 8-8 in FIG. 7.
Figure 9:
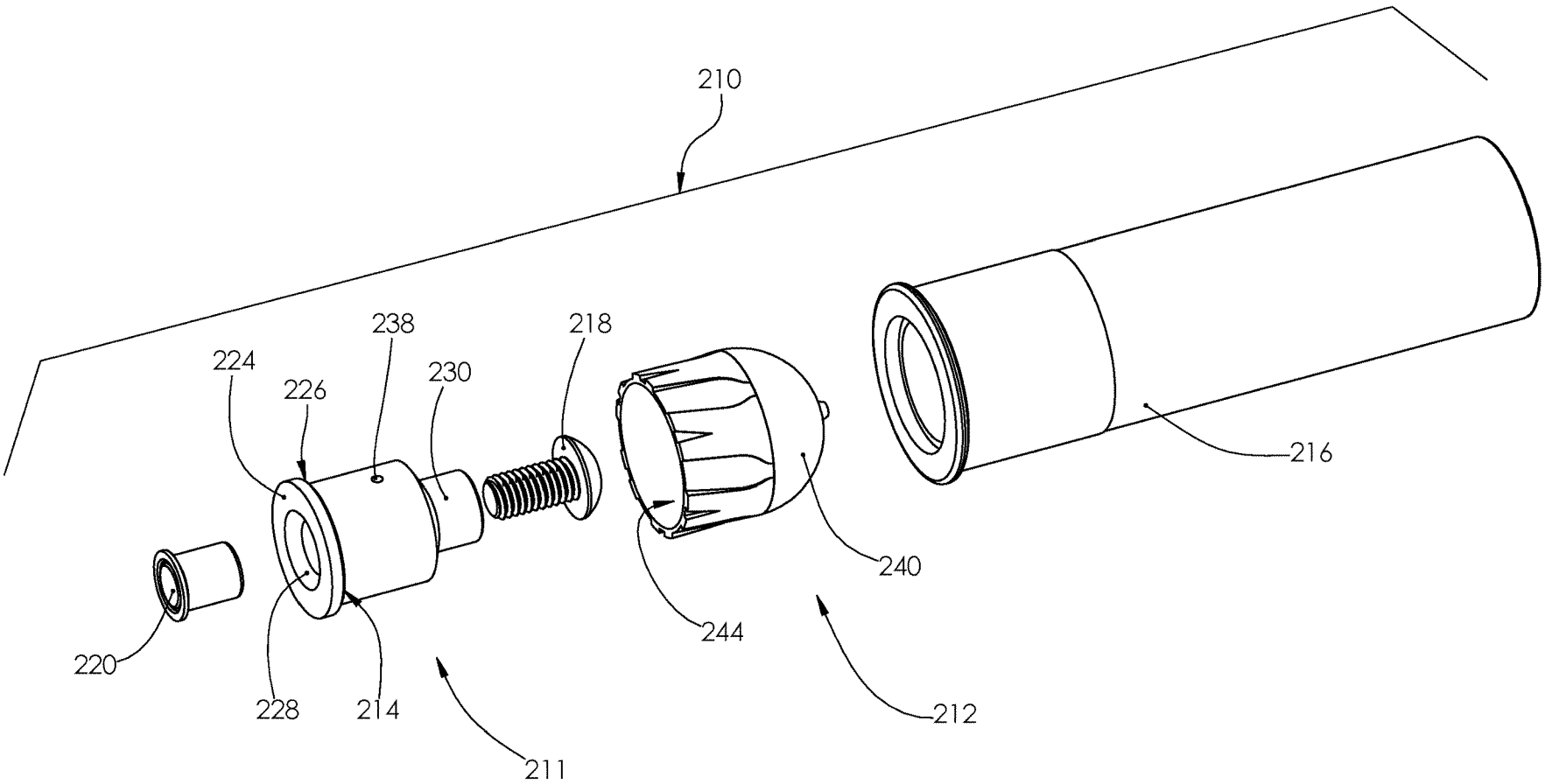
FIG. 9 is an exploded perspective view of the cartridge assembly of FIGS. 7-8.

Referring now to FIGS. 7-9, there is shown another embodiment of a cartridge assembly 210. The cartridge assembly 210 may be substantially similar to the cartridge assembly 110, as discussed above, except that the housing 214 has a different profile than the housing 114 to create a larger launch chamber 236. Like components have been identified with like reference characters, except for the 200 series designation.

The housing 214 is located within and substantially surrounded by the carrier 211. Thus, the housing 214 sits flush with the outer rim of the casing 211. The housing 214 still receives the primer 220 and the removably connected plug 218. However, the housing 214 has a smaller diameter than the housing 114, as discussed above. The stepped down portion 230 of the housing 214 also has an angled or slanted profile which allows for a gradual transition in between the first and second sections of the housing 214. The smaller profile of the housing 214 in turn creates a larger launch chamber 236. The larger launch chamber 236 allows pressurized air to act upon a larger surface area of the vertical wall of the rear cavity 44. As can be appreciated, the launch chamber 236 helps to reduce the risk of prematurely rupturing or fracturing the projectile 112.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cartridge assembly, comprising:

a non-lethal projectile having a rear cavity; and a carrier configured for retaining and launching the non-lethal projectile, the carrier including:

a housing including a combustion chamber, a stepped down portion and at least one escape aperture fluidly connected to the combustion chamber, the combustion chamber being configured for housing an ignitable powder, the stepped down portion extending over half way into the rear cavity of the projectile;

a primer connected to the housing and at least partially disposed within the combustion chamber, the primer being configured for igniting the ignitable powder within the combustion chamber; and a case connected to the housing, the case encasing the non-lethal projectile, the case and the housing collectively defining a launch chamber that is fluidly connected to the at least one escape aperture, the launch chamber being configured for launching the non-lethal projectile out of the case, wherein the at least one escape aperture is configured for metering pressurized gas from the combustion chamber to the launch chamber for launching the non-lethal projectile.

2. The cartridge assembly of claim 1, wherein the at least one escape aperture is configured for metering pressurized gas so that a pressure in the launch chamber is lower than a pressure in the combustion chamber upon ignition of the ignitable powder.

3. The cartridge assembly of claim 1, wherein the housing further includes a first section with a first outer diameter and a second section with a second outer diameter that is smaller than the first outer diameter.

4. The cartridge assembly of claim 3, wherein the non-lethal projectile has an end, wherein the casing has an interior surface, wherein the second section of the housing has an exterior surface, wherein the end of the non-lethal projectile, the interior surface of the casing, and the exterior surface of the second section of the housing collectively define the launch chamber.

5. The cartridge assembly of claim 1, further including a plug removably connected to the housing, the plug touching the projectile.

6. The cartridge assembly of claim 5, wherein the combustion chamber axially extends through the housing such that one end of the combustion chamber is closed by the primer and the other end of the combustion chamber is closed by the plug.

7. The cartridge assembly of claim 6, wherein the plug is in the form of a screw.

8. The cartridge assembly of claim 1, wherein the housing has a first end and a second end, the first end is open such that the primer is received therein, the second end is closed.

9. The cartridge assembly of claim 1, wherein the housing has a slanted profile.

10. The cartridge assembly of claim 1, wherein the non-lethal projectile is in the form of a frangible non-lethal projectile.

11. The cartridge assembly of claim 1, wherein the non-lethal projectile includes a front closed cavity configured for housing a payload and an open rear cavity that at least partially surrounds the housing.

12. A carrier for a non-lethal projectile, comprising:

a housing including a combustion chamber, a stepped down portion and at least one escape aperture fluidly connected to the combustion chamber, the combustion chamber being configured for housing an ignitable powder, the stepped down portion extending over half way into a rear cavity of the non-lethal projectile;

a primer connected to the housing and at least partially disposed within the combustion chamber, the primer being configured for igniting the ignitable powder within the combustion chamber; and a case connected to the housing, the case being configured for encasing the non-lethal projectile, the case and the housing collectively defining a launch chamber that is fluidly connected to the at least one escape aperture, the launch chamber being configured for launching the non-lethal projectile out of the case, wherein the at least one escape aperture is configured for metering pressurized gas from the combustion chamber to the launch chamber for launching the non-lethal projectile.

13. The carrier of claim 12, wherein the at least one escape aperture is configured for metering pressurized gas so that a pressure in the launch chamber is lower than a pressure in the combustion chamber upon ignition of the ignitable powder.

14. The carrier of claim 12, wherein the housing further includes a first section with a first outer diameter and a second section with a second outer diameter that is smaller than the first outer diameter.

15. The carrier of claim 14, wherein the non-lethal projectile has an end, wherein the casing has an interior surface, wherein the second section of the housing has an exterior surface, wherein the end of the non-lethal projectile, the interior surface of the casing, and the exterior surface of the second section of the housing collectively define the launch chamber.

16. The carrier of claim 12, further including a plug removably connected to the housing, the plug touching the projectile.

17. The carrier of claim 16, wherein the combustion chamber axially extends through the housing such that one end of the combustion chamber is closed by the primer and the other end of the combustion chamber is closed by the plug.

18. The carrier of claim 17, wherein the plug is in the form of a screw.

19. The carrier of claim 12, wherein the housing has a first end and a second end, the first end is open such that the primer is received therein, the second end is closed.

20. The carrier of claim 12, wherein the housing has a slanted profile.

* * * * *